US006742372B2

(12) United States Patent
Baulier

(10) Patent No.: US 6,742,372 B2
(45) Date of Patent: Jun. 1, 2004

(54) HEMMING MACHINE

(75) Inventor: Dominique Baulier, Windsor, CA (US)

(73) Assignee: Valiant Corporation, Windsor (CA)

( * ) Notice: Subject to any disclaimer, the term of this patent is extended or adjusted under 35 U.S.C. 154(b) by 0 days.

(21) Appl. No.: 10/022,327

(22) Filed: Dec. 14, 2001

(65) Prior Publication Data

US 2003/0110823 A1 Jun. 19, 2003

(51) Int. Cl.[7] ..... B21D 39/02
(52) U.S. Cl. ..... 72/322; 72/412; 29/243.58
(58) Field of Search ..... 72/306, 322, 323, 72/412; 29/243.58, 243.57

(56) References Cited

U.S. PATENT DOCUMENTS 2,455,767 A * 12/1948 Henchert
4,484,467 A * 11/1984 Kitano
4,604,786 A * 8/1986 Howie, Jr.
5,454,261 A * 10/1995 Campian
6,000,118 A * 12/1999 Biernat
6,257,043 B1 7/2001 Wiens ..... 72/412
6,474,128 B1 * 11/2002 Liu

* cited by examiner

*Primary Examiner*—Daniel C. Crane
(74) *Attorney, Agent, or Firm*—Gifford, Krass, Groh, Sprinkle, Anderson & Citkowski, P.C.

(57) ABSTRACT

A machine for hemming a sheet metal assembly is disclosed in which the sheet metal assembly includes an inner sheet metal panel and an outer sheet metal panel. The outer panel also has an outer lip which lies in a plane transverse with respect to the plane of the inner panel from a bend line in the outer panel. The inner panel also has an outer edge spaced inwardly a few millimeters from the bend line of the outer panel. The apparatus includes a base and a nest adapted to receive and support the sheet metal assembly, and this nest is movably mounted relative to the base. A final hem tool mounted to the base performs a final hem operation. This final hem tool has a generally planar section overlying the outer edge of the inner panel and a portion of the lip following a prehem operation. The final hemming tool also includes a second curvilinear section adjacent the first planar section and this second curvilinear section overlies the remainder of the lip and extends to the bend line. A tangent of the curvilinear section intersects the plane of the first planar section at an angle of less than 20°. A conventional actuator is utilized to move the nest relative to the sheet metal assembly to compress the sheet metal assembly against the final hemming tool to complete the hem.

7 Claims, 3 Drawing Sheets

HEMMING MACHINE

BACKGROUND OF THE INVENTION

I. Field of the Invention

The present invention relates generally to a machine for hemming sheet metal assemblies.

II. Description of Related Art

There are many previously known hemming machines. Many industries, such as the automotive industry, utilize sheet metal hemming machines to secure two metal panels together. These sheet metal hemming machines typically comprise a base and hemming tooling mounted to the base. A nest is mounted to the base and the nest and tooling are movable relative to each other. The nest, in turn, supports the part to be hemmed.

At least one, and typically two or more, hemming tool sets are laterally slidably mounted to the base and movable between an extended position and a retracted position. In the extended position, the hemming tool overlaps the nest so that the relative vertical displacement between the nest and the hemming tool causes the part to be hemmed to be compressed between the hemming tool and the nest. Typically, a prehem is first formed by a prehem tool to bend an outer lip of the outer sheet metal panel at an angle of approximately 45° relative to the plane of the second or inner sheet metal panel while a final hem die retrorsely flattens the sheet metal hem together.

When performing a hemming operation with the previously known hemming machines, the outer lip on the outer panel is typically folded over the outer peripheral edge of the inner panel so that, following the hemming operation, the outer edge of the inner panel is sandwiched in between the outer sheet metal panel and the outer lip on the sheet metal panel. As such, the hem has a thickness equal to twice the thickness of the outer panel plus the thickness of the inner panel and the bending radius is equal to one-half this thickness. When the inner and outer panels are of the same thickness, the radius of the bend for the previously known hemming machines is equal to 1.5 times the thickness of the sheet metal panel.

While many previously known sheet metal hemming machines produce a smooth hem, the relatively large bend radius of the fold line as viewed from the outside in some cases may reflect light in a number of different directions due to the relatively large radius of the hemming bend. This, in turn, creates a visual optical illusion of increasing the gap space between the hem and the adjacent panel. In many industries, and particularly the automotive industry, minimization of the gap space between adjacent panels is highly desirable and improves the quality perception by the customer. Consequently, these previously known hemming machines disadvantageously increase the visual illusion of the gap space between adjacent panels.

A still further disadvantage of these previously known hemming machines is that the hem is oftentimes subjected to over compression during the hemming operation. Such over compression results in "transparency" or "witness" marks, rollback, outside rope and other hemming defects.

SUMMARY OF THE PRESENT INVENTION

The present invention provides a hemming machine which overcomes all of the above-mentioned disadvantages of the previously known devices.

In brief, the present invention is designed to hem an outer and inner sheet metal panel together. The outer sheet metal panel includes an outer lip which lies in a transverse plane with respect to the plane of the inner panel. The lip extends from a bend line in the outer panel to a free edge of the outer panel. The inner panel also includes an outer edge which is spaced inwardly from the bend line in the outer panel by a few millimeters and typically two to three millimeters prior to the prehem operation.

The hemming machine comprises a base and a nest which is vertically slidably mounted relative to the base. The nest, furthermore, is adapted to receive and support the sheet metal assembly to be hemmed.

A final hemming tool is mounted to the base and this tool includes a first generally planar section which overlies the outer edge of the inner panel as well as a portion of the lip on the outer panel. The final hemming tool further includes a second curvilinear section formed on a radius of between three and 100 millimeters adjacent the first planar section. The second curvilinear section is oriented such that its tangent intersects the plane of the first planar section at an angle $\alpha$ where $0° < \alpha < 20°$. The second curvilinear section overlies the remainder of the lip and extends to the bend line in the outer panel.

Conventional means are provided for moving the nest relative to the base. In doing so, the sheet metal assembly compresses against the final hemming tool and sandwiches the outer edge of the inner panel between the outer panel and the lip of the outer panel. However, unlike the previously known hemming devices, small angle, i.e. less than 20°, of intersection of the curvilinear section with the first planar section of the final hem tool creates a relatively small bending of the lip over the inner panel edge and relatively sharp radius bend along the bend line in the outer panel so that the total thickness of the final hem at the bend line is, at most, twice the thickness of the outer sheet metal panel. This relatively small thickness hem at the outer edge in turn has little or no adverse effect on the visual gap space between the hem and the adjacent panel.

The final hemming tool optionally includes a third planar section which is aligned with the nest and is positioned outwardly from the bend line on the outer sheet metal panel. This third section lies in a plane perpendicular to the direction of travel between the nest and the hemming tooling and is dimensioned to flatly abut against a mating surface on the nest during the hemming operation and thus limit the compression of the inner and outer sheet metal panels between the final hemming tool and the nest without any dispersion introduced by the compliance of the hemming machine. This, in turn, minimizes hemming defects, such as transparency marks, rollback and outside rope, that can result from over compression of the sheet metal assembly between the nest and hemming tool.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
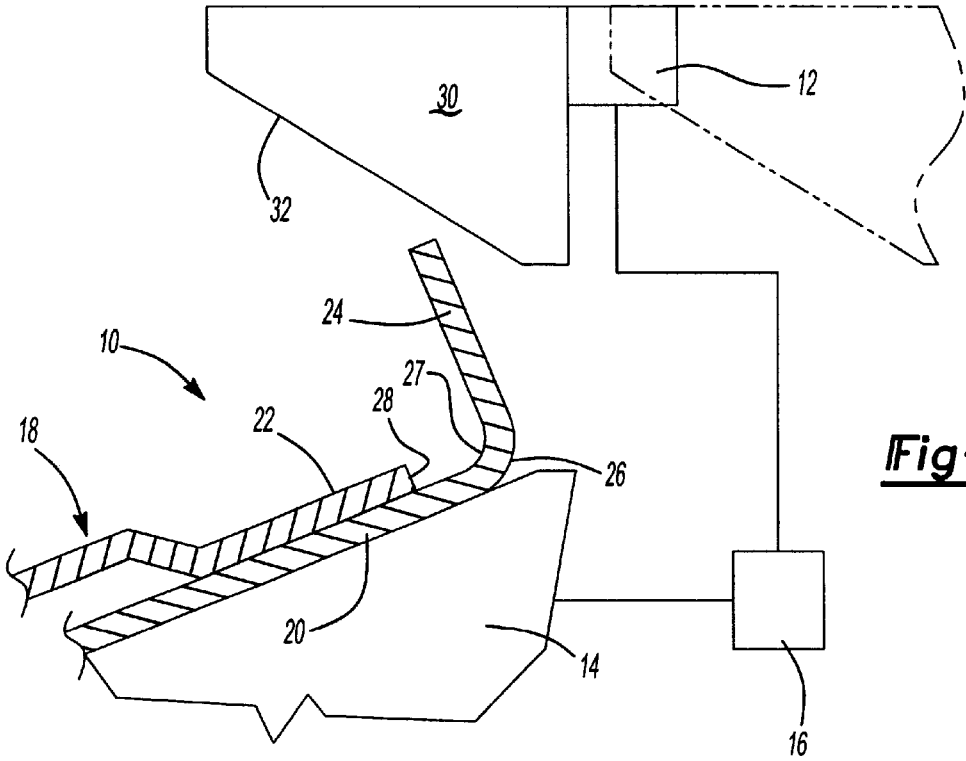
FIGS. 1 and 2 are diagrammatic views illustrating the preferred embodiment of the invention performing a prehemming operation.
Figure 2:
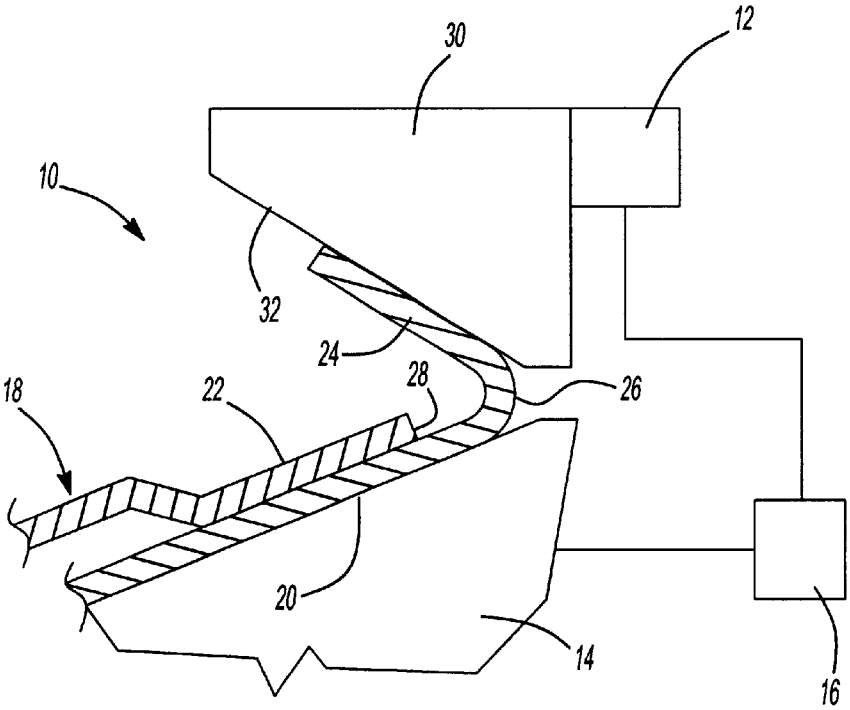

With reference first to FIGS. 1 and 2, a preferred embodiment of the hemming machine 10 is there shown and comprises a base 12 (illustrated only diagrammatically) which is supported on a ground surface. A nest 14 (illustrated only diagrammatically) is vertically slidably mounted relative to the base 12 and movable from the position shown in FIG. 1 and to the position shown in FIG. 2. Any conventional actuator 16, such as a hydraulic actuator, electric motor, pneumatic actuator, or the like, may be used to vertically move the nest 14 relative to the base 12. Although conventionally the base 12 with its hemming tooling is stationary in a vertical direction and the nest 14 is vertically slidably mounted to the base, alternatively the nest may be stationary in the vertical direction while the tooling mounted to the base is vertically movable.

Still referring to FIGS. 1 and 2, the nest 14 is adapted to support a sheet metal assembly 18 having an outer panel 20 and an inner panel 22. Furthermore, the outer panel 20 includes an outer lip 24 which lies in a plane transverse to the plane of the inner sheet metal panel 22 and the lip 24 extends from a bend line 26 in the outer panel 20 to the free edge of the outer panel 20. Furthermore, the inner panel 22 includes an outer edge 28 which is spaced inwardly from an inner bend line 27 by a few millimeters, typically two to three millimeters and preferably about 2.3 millimeters for a 0.9 millimeter thick outer panel.

FIGS. 1 and 2 illustrate a prehem operation using a prehem tool 30. The prehem tool 30 is conventional in construction and has a generally planar face 32 which is aligned with the outer lip 24 on the outer panel 20. Furthermore, the face 32 is skewed at an acute angle of about 45° relative to the plane of the sheet metal panels 20 and 22.

The prehem tool 30 is mounted by lateral slides to the base 12 so that the prehem tool is movable between an operative position, illustrated in solid line in FIGS. 1 and 2, and a retracted position, illustrated in phantom line in FIG. 1. In its operative position, the prehem tool overlies the lip 24 on the outer panel 20 while in its retracted position, the prehem tool is spaced laterally outwardly from the sheet metal assembly 18.

During a prehem operation, with the prehem tool 30 in its operative position, the actuator 16 moves the nest 14 from the position shown in FIG. 1 and to the position shown in FIG. 2 in which the outer lip 24 on the outer panel 20 compresses against the face 32 of the prehem tool 30. In doing so, the lip 24 is bent at an acute angle of approximately 45° inwardly towards the inner panel 22 so that a portion of the lip 24 overlies the outer edge 28 of the inner panel 22.

Figure 3:
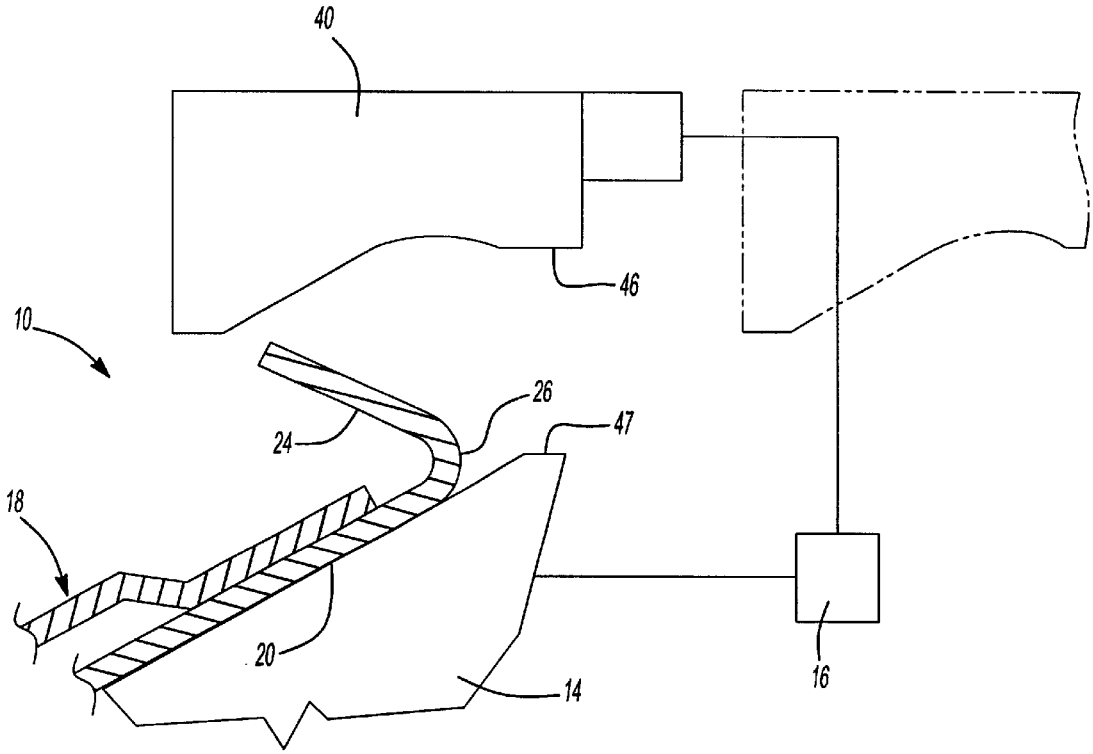
FIGS. 3 and 4 are diagrammatic views illustrating the preferred embodiment of the present invention performing a final hem operation.
Figure 4:
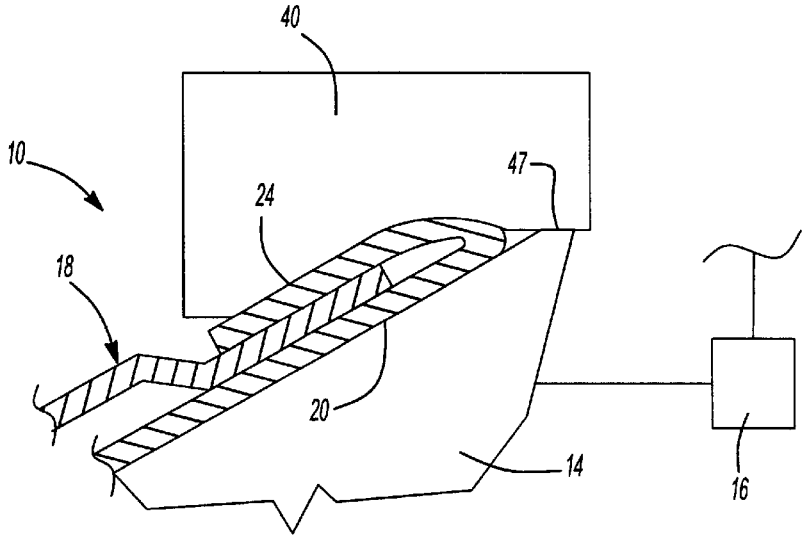

With reference now to FIGS. 3 and 4, a final hemming operation is there shown diagrammatically. In FIG. 3, following the prehem operation (FIGS. 1 and 2) the nest 14 is aligned with a final hemming tool 40 which is mounted on slides to the base 12 so that the final hemming tool 40 is movable between an operative position, illustrated in solid line in FIGS. 3 and 4, and a retracted position, illustrated in phantom line in FIG. 3. In its operative position (solid line in FIGS. 3 and 4), the final hemming tool 40 overlies the outer lip 24 of the outer panel 20 whereas in its retracted position (phantom line in FIG. 3) the final hemming tool is spaced laterally outwardly away from the sheet metal assembly 18.

During the final hemming operation, the actuator 16 moves the nest 14 relative to the final hemming tool 40 from the position shown in FIG. 3 and to the position shown in FIG. 4. In the position shown in FIG. 4, the outer lip 24 is compressed against the final hemming tool 40 thus sandwiching the outer edge of the inner panel 22 in between the lip 24 and outer panel 20 thus securing the panels 20 and 22 together.

Figure 5:
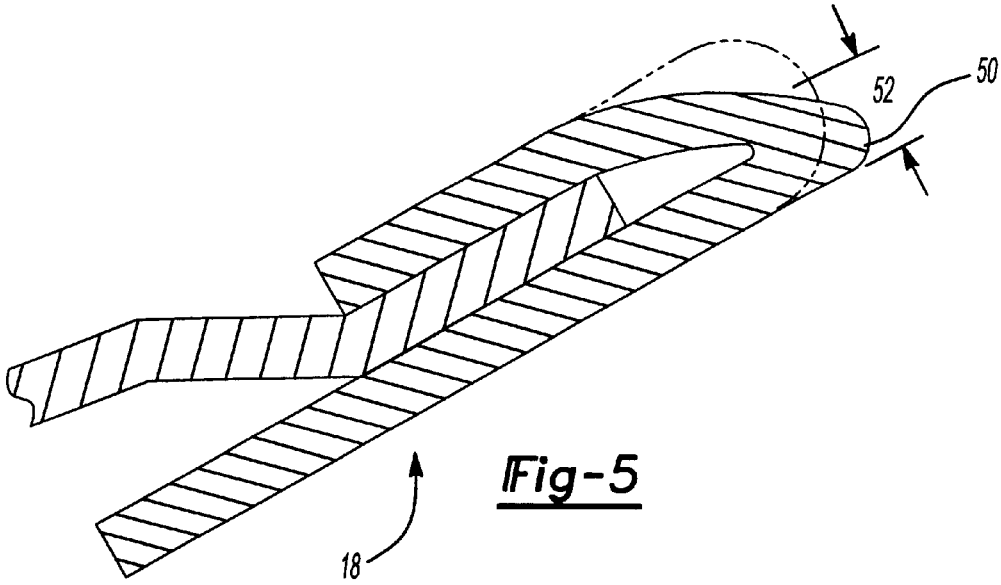
FIG. 5 is a fragmentary view illustrating a hem performed by the preferred embodiment of the present invention.
Figure 6:
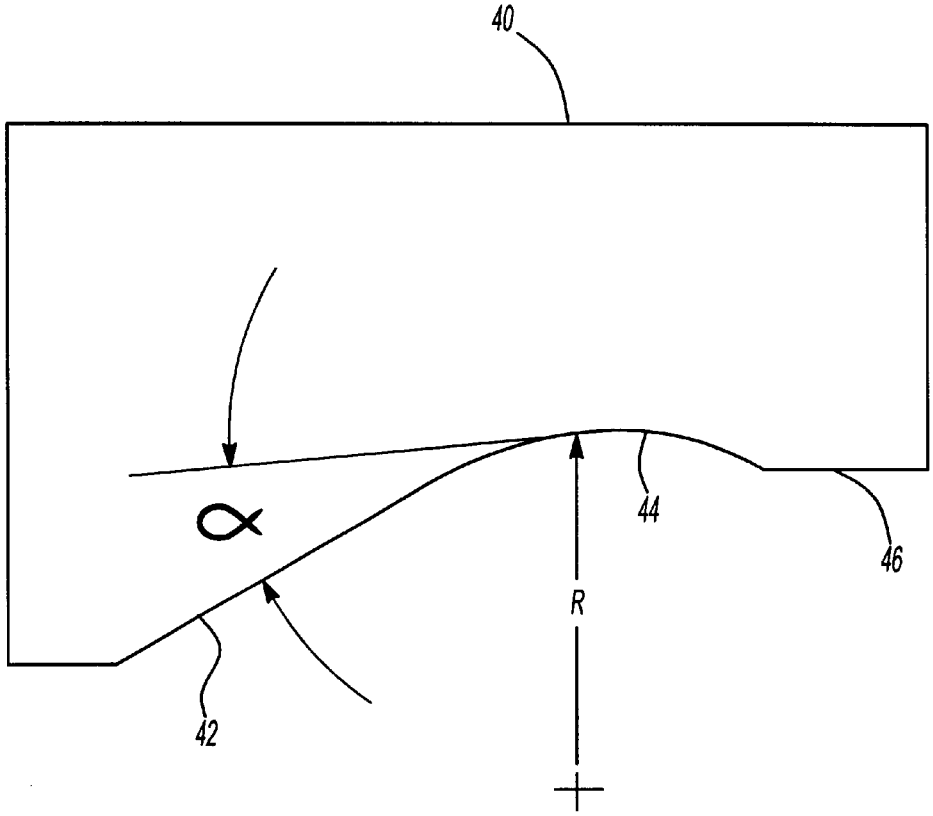
FIG. 6 is a side view illustrating a preferred embodiment of the final hem tool of the present invention.

With reference now particularly to FIG. 5, the final hemming tool 40 is there shown in greater detail and comprises a first generally planar section 42 which overlies both the outer edge 28 of the inner panel 22 as well as a portion of the lip 24 when the final hemming tool 40 is in its operative position, i.e. as shown in solid line in FIGS. 3 and 4. The final hemming tool 40 further includes a second curvilinear section 44 adjacent the first planar section 42. This curvilinear section 44 is aligned with the remainder of the outer lip 24 of the outer panel 20 and extends to the bend line 26 in the outer panel when the final hemming tool 40 is in its operative position.

The curvilinear section 44, furthermore, is formed on a radius R of between 3 and 100 millimeters. A tangent of the curvilinear section 44 also intersects the plane of the planar section 42 of the final hemming tool 40 at an angle $\alpha$ where $0° \leqq \alpha < 20°$. Alternatively, the second section 44 may be planar provided that the angle of intersection between the first and second sections 42 and 44 is less than 20°.

The final hemming tool 40 also optionally includes a third section 46 adjacent the curvilinear section 44 such that the curvilinear section 44 extends between the planar section 42 and planar section 46. Furthermore, the third planar section 46 lies in a plane generally perpendicular to the direction of movement between the nest 14 and final hemming tool 40. The planar section 46 is also aligned with and adapted to flatly abut against a mating surface 47 on the nest 14 during the final hemming operation. In doing so, the cooperation between the section 46 of the hemming tool 40 and the nest mating surface 47 limits the amount of compression of the sheet metal assembly 18 between the nest 14 and final hemming die 40. By so limiting the amount of compression of the sheet metal assembly, the previously known hemming defects from over compression, such as transparency marks, rollback and outside rope on the final hemmed part, are completely avoided.

Although the final hem may be achieved by a single compression of the part against the final hemming tool 40, alternatively the final hem may be better achieved by two sequential compressions of the part against the final hemming tool 40 letting the part to recover its free position without buckling tension from the first strike prior to its second strike for final calibration.

A hem produced by the final hemming tool 40 is illustrated in FIG. 5. As shown in FIG. 5, the outermost edge 50 of the now hemmed sheet metal assembly 18 has a width 52 substantially less than the width of a triple layer sheet metal assembly of the type formed by the previously known hemming machines. As such, a hem performed by the hemming machine of the present invention enjoys a better visual appearance of minimal gap width between adjacent panels than obtainable by the previously known hemming machines.

A primary advantage of the small angle of intersection, i.e. less than 20°, between the first planar section 42 and the tangent of the second curvilinear section 44 is that lateral displacement of the inner panel 22 during the final hem is minimized or altogether eliminated.

From the foregoing, it can be seen that the present invention provides a hemming machine, and particularly a design for the final hemming tool, that overcomes all of the above-mentioned disadvantages of the previously known hemming machines. Having described my invention, however, many modifications thereto will become apparent to those skilled in the art to which it pertains without deviation from the spirit of the invention as defined by the scope of the appended claims.

I claim:

1. A machine for hemming a sheet metal assembly, the sheet metal assembly having an inner sheet metal panel and an outer sheet metal panel, the outer panel having an outer lip lying in a plane extending transversely with respect to the plane of the inner panel from a bend line in the outer panel, the inner panel having an outer edge spaced inwardly from the bend line of the outer panel, said machine comprising:

a base, a final hemming tool mounted to said base, said final hemming tool having a first generally planar section, said final hemming tool having a second curvilinear section adjacent said first planar section, a nest adapted to receive and support the sheet metal assembly so that said sheet metal assembly is oriented, prior to hemming, with the first generally planar section overlying the outer of the inner panel and a portion of the lip, and the second curvilinear section overlying the remainder of said lip and extending to the bend line, means for moving said nest relative to said final hemming tool so that the sheet metal assembly compresses against said final hemming tool with the second curvilinear section engaging both the remainder of the lip and the bend line and with the first generally planar section engaging the lip to press the lip against the inner panel.

2. The invention as defined in claim 1 wherein a tangent on said second curvilinear section at its junction with the first planar section intersects the plane of the first planar section at an angle $\alpha$ where $0° \leqq \alpha < 20°$.

3. The invention as defined in claim 1 wherein said final hemming tool further comprises a third section adjacent said second curvilinear section, said third section being aligned with a mating surface on said nest at a position spaced outwardly from the lip on the outer sheet metal panel and dimensioned to abut against said mating surface on said nest during a final hemming operation to thereby limit the extent of movement of the nest against said final hemming tool, said third section of said final hemming tool and said nest mating surface lying in a plane perpendicular to the direction of movement between said nest and said final hemming tool.

4. The invention as defined in claim 3 wherein said third section of said final hemming tool is substantially planar.

5. The invention as defined in claim 1 wherein said second curvilinear section is formed on a radius of greater than three millimeters and less than 100 millimeters.

6. The invention as defined in claim 1 and comprising a prehem tool mounted to said base, said prehem tool having a tool face adapted to engage and bend the outer panel lip toward the inner panel so that a plane of the lip lies at an acute angle relative to the plane of the inner panel during a prehem operation.

7. The invention as defined in claim 1 wherein said moving means sequentially compresses the part against the final hemming tool at least twice.

* * * * *